US009471016B2

(12) United States Patent
Nakada et al.

(10) Patent No.: US 9,471,016 B2
(45) Date of Patent: Oct. 18, 2016

(54) FIXING APPARATUS

(71) Applicant: CANON KABUSHIKI KAISHA, Tokyo (JP)

(72) Inventors: Takeharu Nakada, Kawasaki (JP); Sho Taguchi, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/619,562

(22) Filed: Feb. 11, 2015

(65) Prior Publication Data

US 2015/0234330 A1 Aug. 20, 2015

(30) Foreign Application Priority Data

Feb. 14, 2014 (JP) ..... 2014-026096

(51) Int. Cl.
*G03G 15/20* (2006.01)

(52) U.S. Cl.
CPC ..... *G03G 15/2053* (2013.01); *G03G 15/2039* (2013.01); *G03G 15/2042* (2013.01); *G03G 2215/2035* (2013.01)

(58) Field of Classification Search
CPC ..... G03G 2215/2016; G03G 15/2039; G03G 15/2059; G03G 15/2053
See application file for complete search history.

(56) References Cited

U.S. PATENT DOCUMENTS

2008/0138131 A1* 6/2008 Jung ..... G03G 15/2039 399/329
2014/0138372 A1* 5/2014 Ogura ..... G03G 15/2042 219/216

FOREIGN PATENT DOCUMENTS

JP H05-289555 A 11/1993
JP H11-260533 A 9/1999
JP 2003-257592 A 9/2003

* cited by examiner

*Primary Examiner* — David Gray
*Assistant Examiner* — Andrew V Do
(74) *Attorney, Agent, or Firm* — Canon USA, Inc., IP Division

(57) ABSTRACT

A fixing apparatus for fixing an image on a recording material includes a cylindrical film, a heater configured to heat the film, the heater contacting an inner surface of the film, a heat transfer member configured to contact a surface opposite to a surface of the heater that contacts the inner surface of the film, and a support member configured to support the heater. A heat capacity per unit length of a first portion that is a portion of the heat transfer member corresponding to a region near an end of the recording material in a width direction among non-sheet passing region is larger than that of a second portion that is a portion of the heat transfer member corresponding to a center of the recording material in the width direction.

6 Claims, 9 Drawing Sheets

SECTIONAL VIEW

HEATER SECTIONAL VIEW

EXPLODED PERSPECTIVE VIEW

FIXING APPARATUS

BACKGROUND OF THE INVENTION

1. Field of the Invention

The present invention relates to a fixing apparatus included in an image forming apparatus such as an electrophotographic copying machine or an electrophotographic printer.

2. Description of the Related Art

In recent years, an image forming apparatus such as a copying machine or a printer has been requested to achieve shortening of first printout time (FPOT) and more energy saving. Under these circumstances, as a fixing apparatus included in the image forming apparatus, a fixing apparatus using a cylindrical film of a low heat capacity is widely used. The fixing apparatus typically includes a film, a heater that contacts an inner surface of the film, and a pressing member forming a nip portion with the heater via the film, heats a recording material having a toner image formed thereon at the nip portion while conveying it, and fixes the toner image on the recording material. Since time necessary for heating the film of the low heat capacity is short, FPOT can be shortened. Since it is not necessary to supply any large power during standing-by, the fixing apparatus is advantageous to energy saving.

In such a fixing apparatus, when continuous fixing is performed on a small-size recording material, an excessive temperature rise of a region (hereinafter, referred to as non-sheet passing portion) through which no recording material passes, in other words, a non-sheet passing portion temperature rise, may occur.

To deal with this problem, Japanese Patent Application Laid-Open No. 11-260533 discusses a technology for suppressing the non-sheet passing portion temperature rise by arranging heat transfer members having high thermal conductivity on rear and front surfaces of a heating member. However, concerning the non-sheet passing portion temperature rise, a highest temperature position varies depending on the size of a recording material in a direction orthogonal to a conveying direction of the recording material. In a member having a sectional shape uniform in a longitudinal direction as in the case of the heat transfer member discussed in Japanese Patent Application Laid-Open No. 11-260533, a heat capacity of the entire heat transfer member must be set high in order to suppress the non-sheet passing portion temperature rise irrespective of the size of the recording material. Thus, further shortening of FPOT is difficult.

SUMMARY OF THE INVENTION

According to an aspect of the present invention, a fixing apparatus for fixing an image on a recording material includes a cylindrical film, a thin and long heater configured to heat the film and contact an inner surface of the film, a heat transfer member configured to contact, along a longitudinal direction of the heater, a surface opposite to a surface of the heater that contacts the inner surface of the film, and a support member configured to support the heater via the heat transfer member. The image is fixed on the recording material by using heat of the film. A heat capacity per unit length of a first portion that is a portion of the heat transfer member corresponding to a region near an end of the recording material in a width direction among non-sheet passing region of a standard-sized recording material is larger than that of a second portion that is a portion of the heat transfer member corresponding to a center of the standard-sized recording material in the width direction.

Further features and aspects of the present invention will become apparent from the following detailed description of exemplary embodiments with reference to the attached drawings.

DESCRIPTION OF THE EMBODIMENTS

Hereinafter, the exemplary embodiments of the present invention will be described in detail with reference to the drawings.

(1) Image Forming Apparatus

Figure 1:
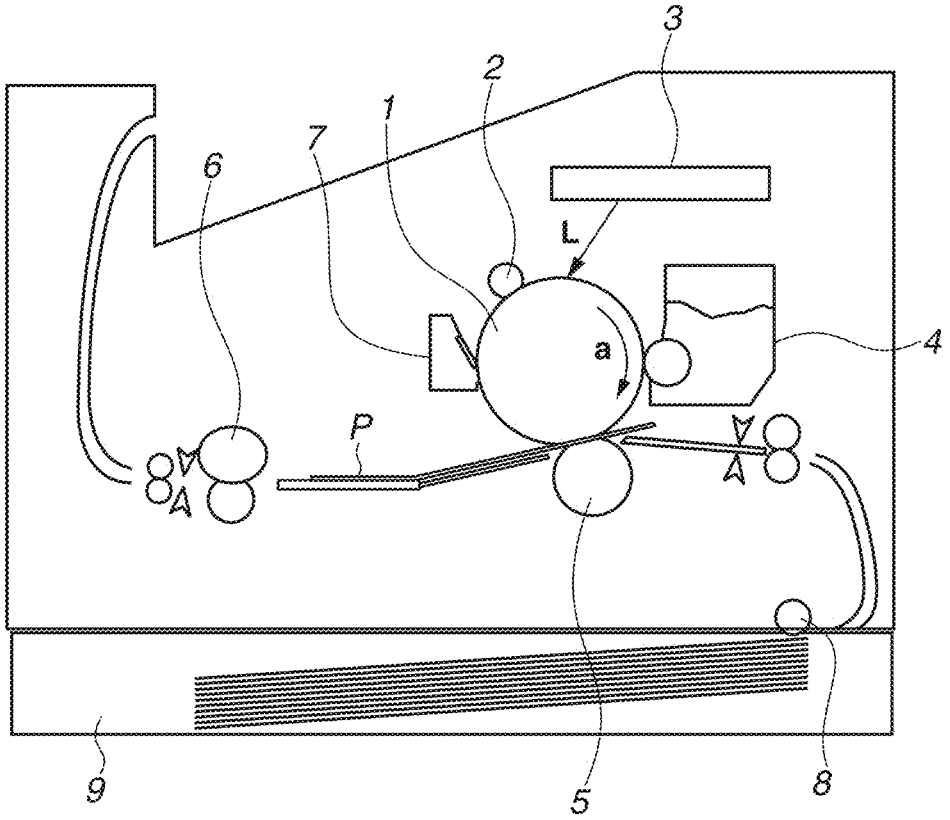
FIG. 1 is a cross-sectional view illustrating an image forming apparatus.

A first exemplary embodiment will be described. FIG. 1 is a schematic diagram illustrating a configuration of an example of an image forming apparatus. The image forming apparatus of the example is a laser printer that uses a transfer electrophotographic process. A photosensitive drum 1 is an image bearing member driven to rotate clockwise in an arrow direction a at a predetermined process speed. The photosensitive drum 1 is configured by forming a photosensitive layer made of organic photoconductor (OPC) or amorphous Si on an outer peripheral surface of a drum electrically-conductive substrate made of aluminum or nickel. The photosensitive drum 1 is uniformly charged to predetermined polarity or potential by a charging roller 2 serving as a charging unit during the rotation. Then, a laser beam scanner 3 subjects a charged surface of the photosensitive drum 1 to scanning exposure L by a laser beam according to image information, thereby forming an electrostatic latent image on the photosensitive drum surface. The electrostatic latent image is developed to be visible by toner T at a developing device 4. Meanwhile, recording materials P accommodated in a sheet supplying cassette 9 are delivered one by one by driving of a feeding roller 8. The delivered recording materials P are fed to a transfer nip portion that is a pressing contact portion of the photosensitive drum 1 and a transfer roller 5 at predetermined control timing, and a toner image of negative polarity on the surface side of the photosensitive drum 1 is transferred sequentially to surfaces of the recording materials P by the transfer roller 5 to which a transfer bias of positive polarity has been applied. A portion up to the formation of the toner image on the recording material P is defined as an image forming portion. The recording materials fed out of the transfer nip portion are introduced to a fixing apparatus (fixing unit) 6 to be subjected to thermal fixing of the toner image. The recording materials P fed out of the fixing apparatus 6 pass through a sheet path including a discharge roller to reach a discharge tray. The photosensitive drum surface from which the recording materials have been separated is subjected to removal of a deposited contaminant such as transfer residual toner by a cleaning device 7 to be cleaned, and repeatedly used for image forming.

(2) Fixing Apparatus

Figure 2A:
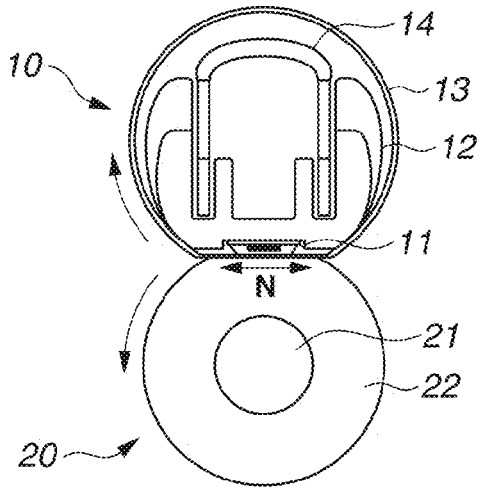
FIG. 2A is a cross-sectional view illustrating a fixing apparatus.
Figure 2B:
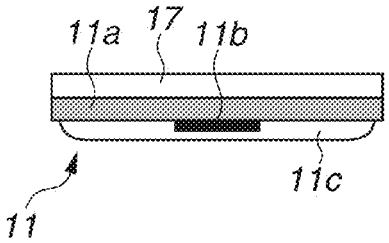
FIG. 2B is a cross-sectional view illustrating a heater and a heat transfer member.
Figure 2C:
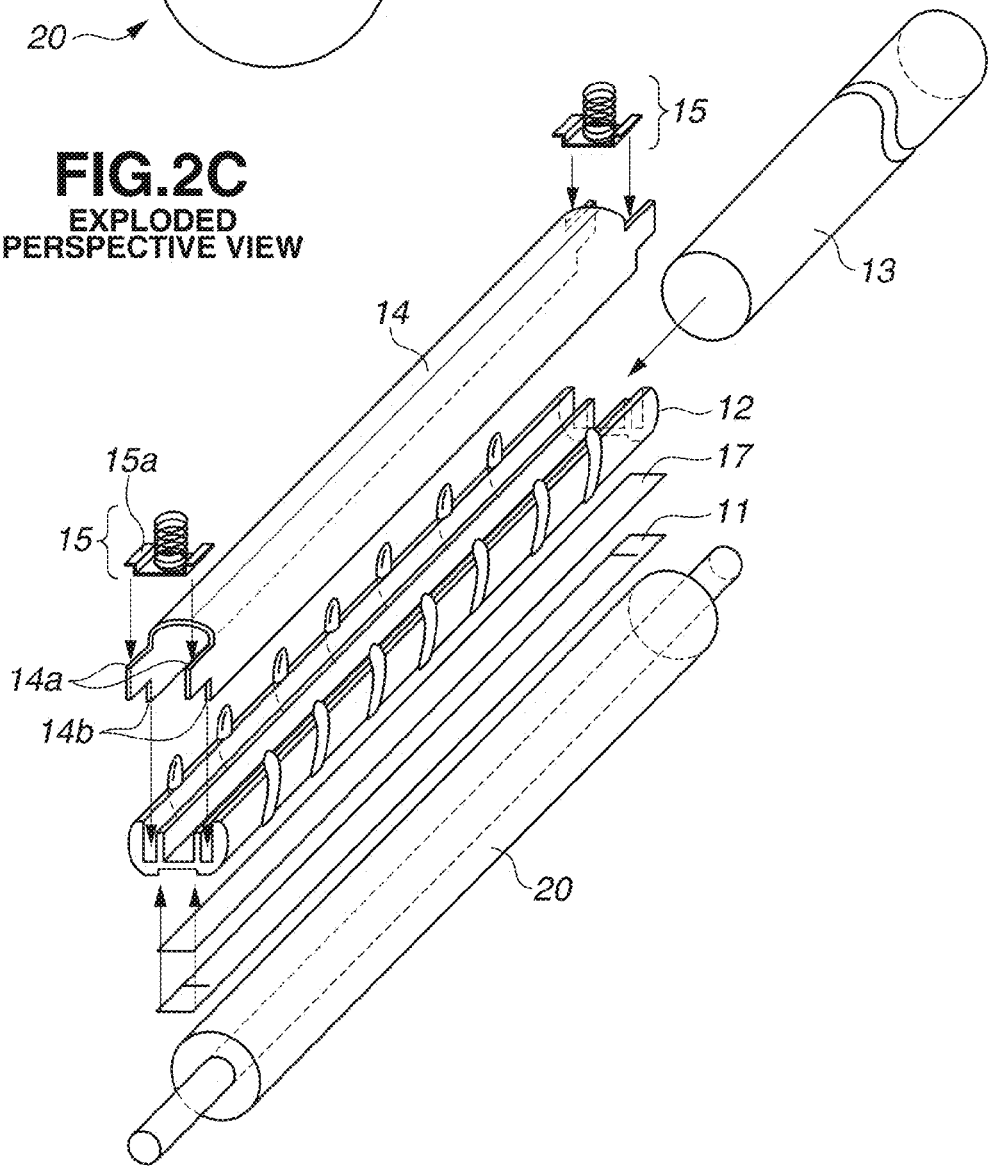
FIG. 2C is an exploded perspective view illustrating the fixing apparatus.

FIGS. 2A and 2C respectively are a cross-sectional view and an exploded perspective view illustrating the fixing apparatus according to the present exemplary embodiment. The fixing apparatus 6 includes a cylindrical film 13 and a pressure roller 20 serving as a pressing member for forming a nip portion between itself and the film 13. A film assembly 10 includes the film 13, a heater 11 that contacts an inner surface of the film 13, a support member 12 for supporting a surface opposite to the side of the heater 11 that contacts the film inner surface, and a reinforcing stay 14 for reinforcing the support member 12. The film assembly 10 is pressed to the pressure roller 20 at both ends of the reinforcing stay 14 in a longitudinal direction by a force of a pressure spring 15.

The film 13 preferably has a thickness equal to or lower than a total thickness of 200 μm in order to achieve high-speed warming-up of the fixing apparatus by reducing a heat capacity. A base layer of the film 13 is formed by a heat resistant resin such as polyimide, polyamide imide, or PEEK, a pure metal such as SUS, Al, Ni, Cu, or Zn having heat resistance and high thermal conductivity, or an alloy. In the case of the resin base layer, in order to improve thermal conductivity, high thermal conductive powders such as BN, alumina, or Al may be mixed. The film 13 is preferably formed with a thickness equal to or higher than a total thickness of 20 μm to improve durability. A preferred total thickness of the film 13 is accordingly equal to or higher than 20 μm to 200 μm or lower. In order to prevent offset and improve separability of the recording material, on a surface of the film, a releasing layer is formed by mixing a highly releasable heat resistant resin such as a fluorine resin or a silicone resin, or by single covering. According to the present exemplary embodiment, the film 13 is a film of a total thickness of 75 μm and an outer diameter ϕ of 18 mm including a PFA surface layer formed with a thickness of 10 μm, a primer layer formed with a thickness of 5 μm, and a polyimide base layer formed with a thickness of 60 μm.

FIG. 2B is a cross-sectional view illustrating the heater 11 serving as a heating member and a heat transfer member 17. The heater 11 comes into contact with the inner surface of the film 13 to heat the film 13. The heater 11 is a thin and long plate member of a low heat capacity. The heater 11 includes a substrate 11*a*, and a heat generation resistor 11*b* formed along a longitudinal direction on the substrate 11*a*. The heater 11 is formed with a thickness of about 10 μm and a width of about 1 to 5 mm by screen printing or the like. The substrate 11*a* is made of insulating ceramics such as alumina or aluminum nitride. The heat generation resistor 11*b* is formed by depositing silver palladium (Ag/Pd), $RuO_2$, or $Ta_2N$ on the substrate 11*a* by screen printing. On a surface where the heater 11 contacts the film 13, a protective layer 11*c* for protecting the heat generation resistor is formed. A preferred thickness of the protective layer is sufficiently small at a level for improving surface property. Generally, glass coating of about 30 to 200 μm is used. In the present exemplary embodiment, a material of the substrate 11*a* is alumina, and dimensions of the substrate 11*a* are 270 mm in length, 6.0 mm in width, and 1.0 mm in thickness. A material of the heat generation resistor 11*b* is Ag/Pd, dimensions of the heat generation resistor 11*b* are 220 mm in length (length of 110 mm from paper center), and a thickness of the glass coating is 60 μm.

The pressure roller 20 includes a core metal 21, and a rubber layer 22 formed outside the core metal 21. The core metal 21 is made of metal such as SUS, SUM, or Al. For the rubber layer 22, a solid rubber layer made of heat resistant rubber such as silicon rubber or fluorine rubber, or a sponge rubber layer formed by foaming silicon rubber is used. For the rubber layer 22, a bubble rubber layer increased in heating insulation effect by dispersing hollow fillers (micro-balloons or the like) in the silicon rubber layer to provide an air portion in a hardened material may be used. As a releasing layer, a releasing layer made of a perfluoroalkoxy resin (PFA) or a polytetra-fluoroethylene resin (PTFE) may be formed outside the rubber layer 22. In the present exemplary embodiment, a pressure roller of an outer diameter ϕ of 20 mm including the core metal 21 made of Al, the rubber layer 22 made of silicon rubber, and a releasing layer (not illustrated) made of PFA is used.

Next, a pressing configuration, a driving configuration, and a control method of the fixing apparatus 6 will be described. In the fixing apparatus 6, the film assembly 10 is pressed to the pressure roller 20 to form a predetermined nip N. In this pressing configuration, as illustrated in FIG. 2C, both ends of the reinforcing stay 14 project from the support member 12, and spring receiving portions 14*a* formed at both ends are pressed by pressure springs 15 via spring receiving members 15*a*. Loads received by the spring receiving portions 14*a* are transmitted in the longitudinal direction of the support member 12 via stay feet 14*b*. Accordingly, at the fixing nip N, the film 13 is sandwiched between the heater 11 and the pressure roller 12 to adhere to a surface of the heater 11.

The driving configuration of the fixing apparatus will be described. The pressure roller 20 acquires a driving force to rotate in an arrow direction illustrated in FIG. 2A by a gear provided at one shaft of the core metal 21 to serve as a driving member that is not illustrated. The driving force is transmitted by a motor that is not illustrated, according to an instruction from a central processing unit (CPU) that is not illustrated, for controlling a control unit. Along with the rotational driving of the pressure roller 20, the film 13 rotates by a friction force received from the pressure roller 20. Providing a lubricant such as fluorine or silicon heat resistant grease between the film 13 and the heater 11 enables smooth rotation of the film 13 by reducing friction resistance.

The control method of the fixing apparatus 6 will be described. The CPU (control unit) controls power supplied to the heat generation resistor 11*b* such that a detected temperature of a temperature detection element such as thermistor (not illustrated) provided in a rear surface of the substrate 11*a* can be maintained at a fixing temperature (target temperature). When the recording material P having an unfixed toner image formed thereon is conveyed through the fixing nip portion, the unfixed toner image is fixed on the recording member by heat from the film 13 heated by the heater 11. Standard-sized recording materials processable in the present exemplary embodiment are LTR, A4, B5, A5, and A6, and the respective sizes are as follows:

LTR: width 216 mm×length 279.4 mm
A4: width 210 mm×length 297 mm
B5: width 182 mm×length 257 mm
A5: width 148 mm×length 210 mm
A6: width 105 mm×length 148 mm (3) Heat Transfer Member The heat transfer member 17 will be described. The heat transfer member 17 is provided between the heater 11 and the support member 12 to be sandwiched therebetween. The heat transfer member 17 is made of a material having higher thermal conductivity than that of the substrate 11*a*. For the heat transfer member 17, a graphite sheet or the like formed by processing aluminum (Al), copper (Cu), silver (Ag), or graphite in a sheet shape can be used. The thermal conductivity of the heat transfer member 17 is preferably 200 W/(mK) or higher at 0° C. The thermal conductivity of alumina is about 20 W/(mK), and the thermal conductivity of pure aluminum nitride is 200 W/(wK). The thermal conductivity of aluminum is 236 W/(mK), the thermal conductivity of copper is 403 W/(mK), the thermal conductivity of silver is 428 W/(mK), and the thermal conductivity of the graphite sheet is 600 to 1500 W/(mK). The heat transfer member 17 may be provided between the film 13 and the heater 11.

Figure 3:
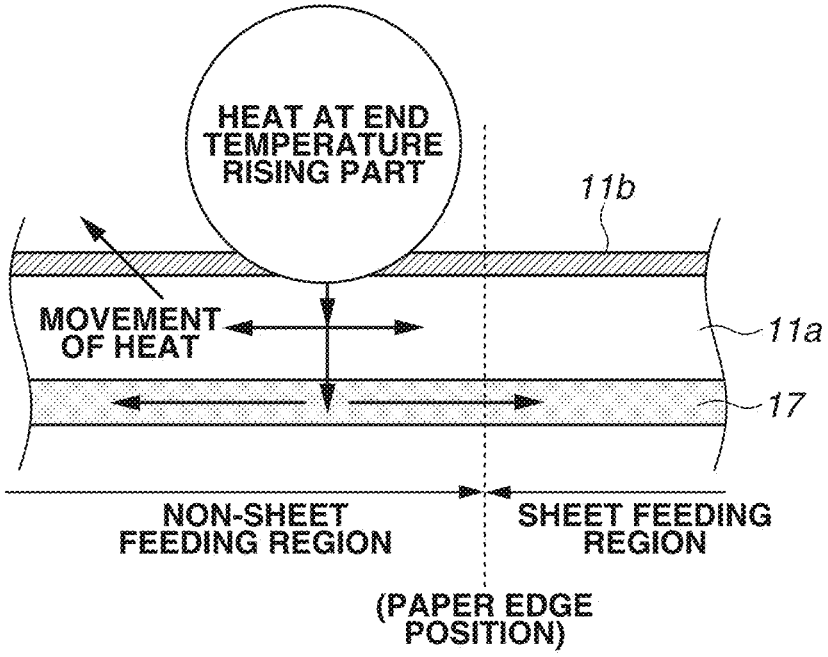
FIG. 3 is a diagram illustrating a heat movement path in the heater and the heat transfer member.

FIG. 3 is a sectional view of a laminated configuration of the heater, the heat transfer member, and the support member according to the present exemplary embodiment, schematically illustrating movement of heat at a position of a non-sheet passing portion temperature rise. In the fixing apparatus 6 according to the present exemplary embodiment, a position where the highest non-sheet passing portion temperature rise occurs exists at 2 to 3 mm outside a paper edge of the recording material to be fed, and is in the non-sheet passing region. By disposing the heat transfer member 17 having thermal conductivity higher than that of the substrate 11*a* in the heater 11, movement of heat in thickness, width, and longitudinal directions advances to greatly reduce a temperature gradient in the entire fixing apparatus. Since heat of the feeding region of the recording material is repeatedly removed by the recording material, a total amount of moving heat is proportional to the temperature gradient, and the heat of the non-sheet passing portion particularly moves to a sheet-feeding portion (sheet-feeding region) through which the recording sheet is fed. There are largely two types of non-sheet passing portion temperature rises. The first non-sheet passing portion temperature rise occurs when a recording material having the largest width except that of the largest width conveyable by the apparatus is subjected to intermittent printing. The intermittent printing has a long interval between a preceding recording material and a succeeding recording material. A recording material is degraded more easily as a set fixing temperature (target temperature) is higher. In the fixing apparatus 6 according to the present exemplary embodiment, this first case is a non-sheet passing portion temperature rise of a recording material of an A4 size. The recording material of the A4 size has a fixing temperature set high since a print speed is fast. The second non-sheet passing portion temperature rise occurs when small-size recording materials are subjected to continuous printing. In the second case, a non-sheet passing portion temperature rise is severer as the width of the recording material is narrower. Among the standard-sized recording materials processable in the present exemplary embodiment, a non-sheet passing portion temperature rise of an A6 size recording material is severest. It is because a non-sheet passing region is wider in the case of a narrower recording material. When such a small size recording material is subjected to continuous printing, throughput-down control is often carried out.

A result of study conducted by the inventors shows that a suppression effect of the non-sheet passing portion temperature rise is higher as a heat capacity of the heat transfer member is larger. Since the heat capacity is represented by a product of mass (product of volume and specific gravity) of a material and specific gravity, the heat capacity increases when a volume of the heat transfer member increases. To increase the volume of the heat transfer member, a width, a length, or a thickness of the heat transfer member may be increased.

Figure 4:
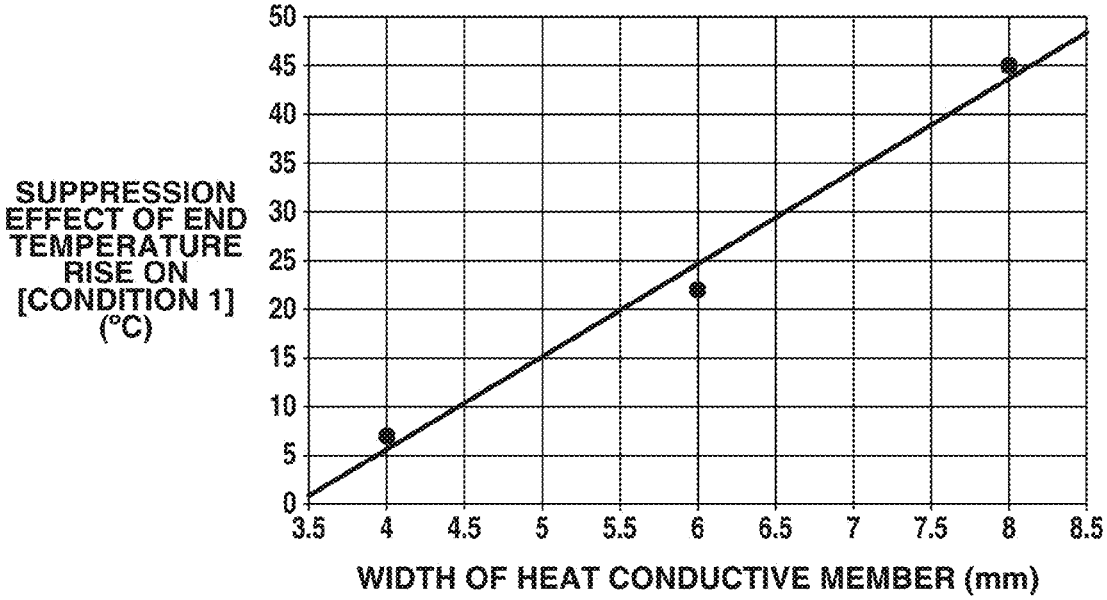
FIG. 4 is a graph illustrating a relationship between a width of the heat transfer member and a suppression effect of a non-sheet passing portion temperature rise.

A relationship between the heat capacity and the non-sheet passing portion temperature rise will be described referring to FIG. 4. In FIG. 4, a horizontal axis indicates a width of the heat transfer member, and a vertical axis indicates a suppression effect (° C.) of the non-sheet passing portion temperature rise. The material of used heat transfer members is aluminum (pure aluminum, alloy number A1050), a length is 214 mm, a thickness is 0.3 mm, and widths are 4.0, 6.0, and 8.0 mm. The thickness and the width of heat transfer member are uniform in the longitudinal direction. The suppression effect of the non-sheet passing portion temperature rise was checked and determined on the basis of how much a surface temperature of the pressure roller 20 was reduced compared with a configuration including no heat transfer member when intermittent printing was carried out. Specific evaluation conditions are as described in detail below.

<Evaluation Conditions of Suppression Effect of Non-Sheet Passing Portion Temperature Rise>

Environment: 15° C./10% (Low-temperature low-humidity environment)
Paper type: Springhill (product name) of A4 size basis weight 199 g/m$^2$
Sheet-feeding mode: 50 pieces of one intermittent print from cold state
Print speed: about 220 mm/s (40 ppm)
Fixing temperature (target temperature): 230° C.

In the evaluation result, end temperature rise suppression effects were 7° C. in the case of a width 4.0 mm of the heat transfer member, 22° C. in the case of a width 6.0 mm, and 45° C. in the case of a width 8.0 mm. In other words, a suppression effect of a non-sheet passing portion temperature rise with respect to a width 1.0 mm is about 10° C., and the suppression effect of the non-sheet passing portion temperature rise is higher as the heat capacity of the heat transfer member is larger.

The heat capacity of the heat transfer member can be increased by increasing a thickness or a length in addition to increasing the width of the heat transfer member.

However, the simple increase of the heat capacity of the heat transfer member affects quick start performance that is an advantage of the fixing apparatus using the film. The quick start performance of the fixing apparatus has a large influence on FPOT (time necessary from when printing is started to when a first recording material is discharged). Several factors determine FPOT, and they are largely classified into the following four items. The first item is image information generation and rasterization time by an image processing unit such as a video controller. The second item is rising time of a motor for rotating a scanner mirror in a laser beam scanner. The third item is a length of a conveyance path and a process speed from sheet feeding to conveyance. The fourth item is quick start performance of the fixing apparatus. High quick start performance of the fixing apparatus means short warming-up time from when power supplying to the fixing apparatus is started to when the fixing apparatus reaches a temperature capable of fixing (fixing temperature).

For the aforementioned reason, when the heat capacity of the heat transfer member increases, the warming-up time of the fixing apparatus is longer, consequently the FPOT may become longer. The warming-up time of the fixing apparatus 6 according to the present exemplary embodiment is longest in the case of the A4 size recording material having a highest fixing temperature.

In view of such a status, it can be understood that while there is a wish to increase the heat capacity of the heat transfer member in order to increase the suppression effect of the non-sheet passing portion temperature rise, the influence on warming-up time shortening must be reduced.

(4) Effect Comparison of Comparative Examples and Embodiment

Figure 5:
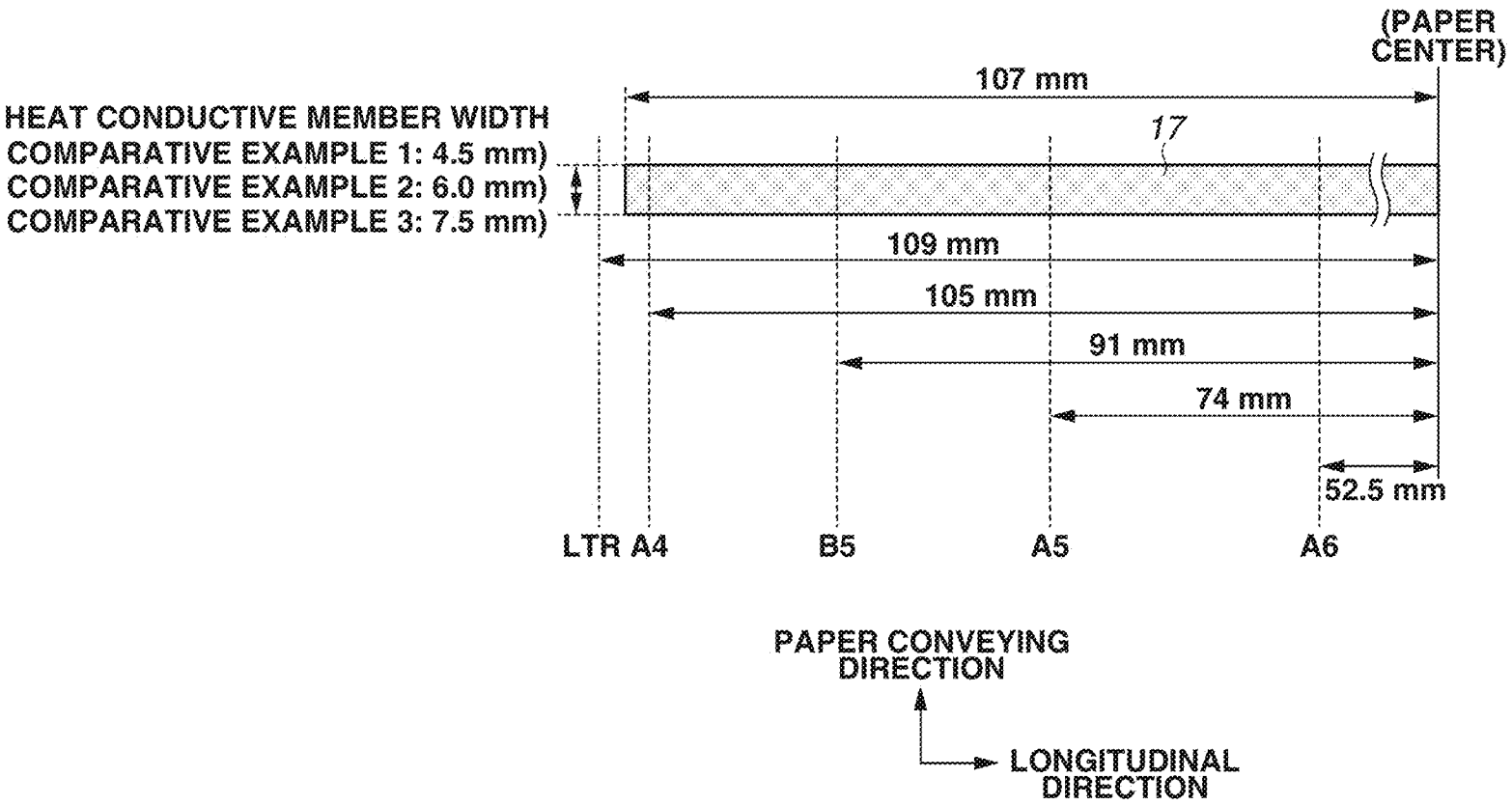
FIG. 5 is a diagram illustrating a shape of a heat transfer member in a longitudinal direction according to a comparative example.

Configurations of heat transfer members 17 according to Comparative Examples 1 to 4 and the first exemplary embodiment will be described referring to FIG. 5. According to the Comparative Example 1, the heat transfer member 17 is made of an aluminum material (pure aluminum, alloy number A1050), and has a length of 214 mm, a width of 4.5 mm, and a thickness of 0.3 mm. The Comparative Examples 2 and 3 are similar to the Comparative Example 1 except for respective widths of 6.0 mm and 7.5 mm. The heat transfer members 17 according to Comparative Examples 1 to 4 are uniform in thickness in a longitudinal direction. Specific gravity of the aluminum is 2.705 g/cm$^2$ (A1050), and specific heat is 0.88 J/gK.

Figure 6:
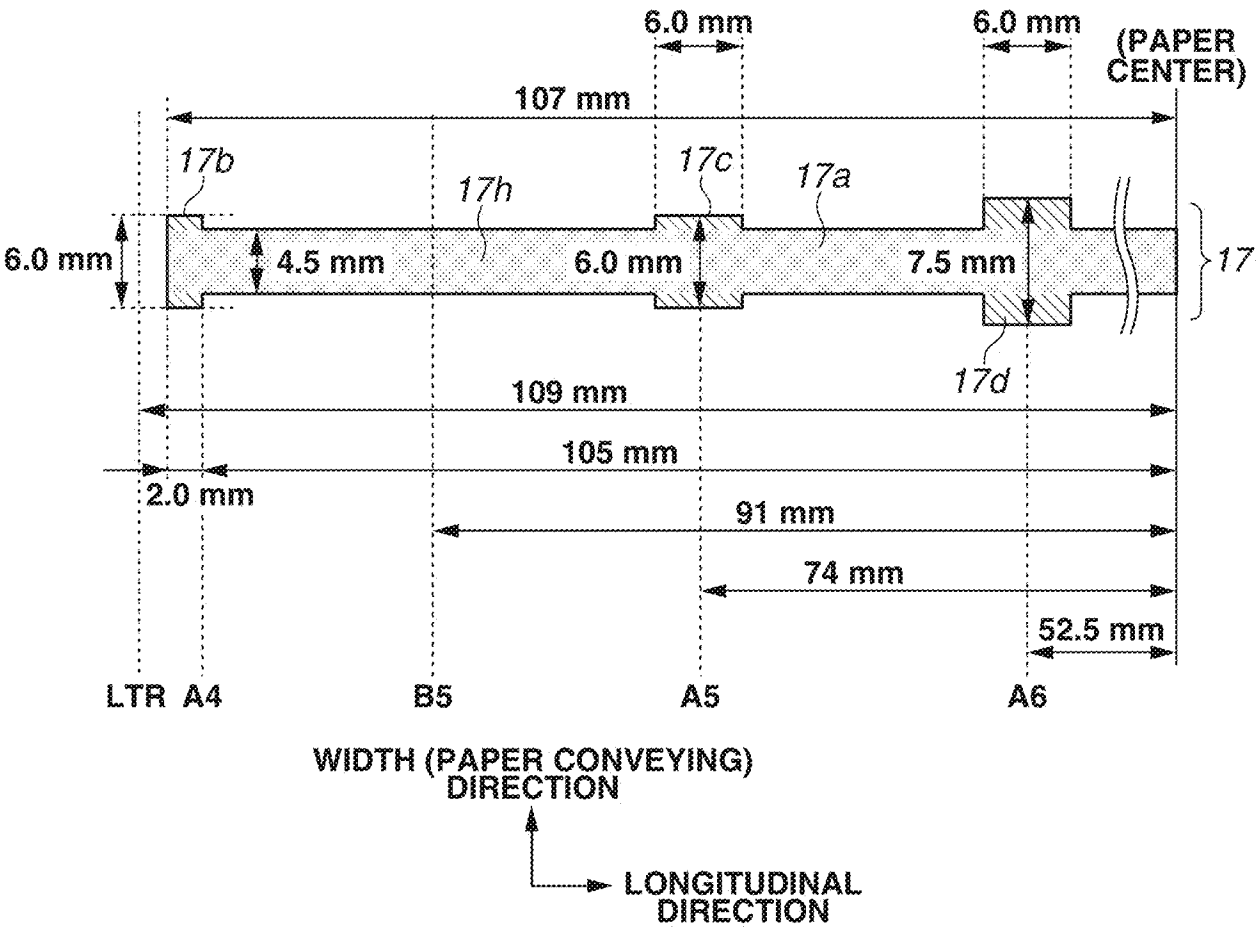
FIG. 6 is a diagram illustrating a shape of a heat transfer member in a longitudinal direction according to a first exemplary embodiment.

The configuration of the heat transfer member 17 according to the first exemplary embodiment will be described referring to FIG. 6 that is a front view illustrating a half from a center in a longitudinal direction. The heat transfer member 17 according to the first exemplary embodiment is made of a material similar to those of the Comparative Examples 1 to 4, and has a length and a thickness similar to those of the Comparative Examples 1 to 4 in the longitudinal direction. As to a width of the heat transfer member 17 according to the first exemplary embodiment, widths (17*b*, 17*c*, and 17*d*) of portions (first portions) corresponding to regions near an end of a recording material in a width direction among standard-size non-sheet passing regions are wider than that of a portion 17*a* (second portion) corresponding to a center region of the standard-sized recording material. This configuration is employed for partially increasing a heat capacity per unit length of the heat transfer member 17 in the longitudinal direction. Specifically, widths of the second portion 17*a* corresponding to the center of each standard-sized recording material and a first portion 17*h* corresponding to a B5 size recording material are 4.5 mm. A width of the first portion 17*b* (105 to 107 mm from the recording material center) corresponding to an A4 size recording material is 6.0 mm, and a width of the first portion 17*c* (69 to 77 mm from the recording material center) corresponding to an A5 size recording material is 6.0 mm. A width of a first portion 17*d* (49.5 to 55.5 mm from the recording material center) corresponding to an A6 size recording material is 7.5 mm. The width of the first portion 17*b* corresponding to the A4 size recording material is smaller than that of the first portion 17*c* corresponding to the A5 size recording material, and the width of the first portion 17*c* corresponding to the A5 size recording material is smaller than that of the first portion 17*d* corresponding to the A6 size recording material. Performance evaluation (non-sheet passing portion temperature rise suppression, and warming-up time shortening) in each configuration is as described in detail below.

[Evaluation Method of Non-Sheet Passing Portion Temperature Rise of A4 Size Recording Material]

o: There is no generated hot-offset.

x: There is a generated hot-offset.

<Evaluation Condition>

Environment: 15° C./10% (Low-temperature low-humidity environment)

Paper type: Springhill of A4 size basis weight 199 g/m$^2$

Sheet-feeding mode: 30 pieces of one intermittent print from a cold state

Print speed: about 220 mm/s (40 ppm in throughput)

Fixing control temperature: 230° C.

[Evaluation Method of Non-Sheet Passing Portion Temperature Rises of B5, A5, and A6 Size Recording Materials]

o: There is no generated hot-offset even without throughput-down control.

x: Throughput-down is necessary for preventing hot-offset generation.

<Evaluation Condition>

Environment: 15° C./10% (Low-temperature low-humidity environment)

Paper type: sheet acquired by cutting Springhill (product name) of A4 size basis weight 199 g/m$^2$ into each standard-sized sheet Sheet-feeding mode: 10 continuous prints from cold state Print speed: about 220 mm/s (40 ppm in throughput), sheet interface is adjusted to achieve 20 ppm in throughput when throughput-down control is carried out.

Fixing control temperature: 190° C. (40 ppm), 150° C. (20 ppm)

[Evaluation Method of Quick Start Performance]

Quick start performance evaluation was carried out by evaluating fixability when FPOT was fixed to 5.0 seconds. Fixability of a fixing apparatus having low quick start performance, in other words, long warming-up time, is low. A value of FPOT 5.0 seconds is arbitrarily selected according to product specifications. For the fixability, an image density after fixing and before rubbing is measured by using a reflection density measuring device such as RD-191 provided by Gretag Macbeth Inc., and then an image surface is rubbed by symbol paper by predetermined times while applying a predetermined load by using a weight or the like. Then, a density after rubbing is measured, and (density-decreasing rate: %)={(image density before rubbing)−(image density after rubbing)}/(image density before rubbing)×100 is calculated. Specific conditions during fixability evaluation are as described below. Because of the density-decreasing rate, fixability is higher as a value is smaller. When the density-decreasing rate was 20% or higher, an image defect (image peeling) of a visible level was generated.

o: The density-decreasing rate is less than 20%.

x: The density-decreasing rate is equal to or higher than 20%.

<Fixability Evaluation Condition>

Environment: 15° C./10% (Low-temperature low-humidity environment)

Input voltage: 120 V

FPOT: fixed to 5.0 seconds

Image pattern: halftone image of black toner (K)
Paper type: OceRedlabel (product name) of A4 size basis weight 80 g/m$^2$
Sheet-feeding mode: 1 from cold state
Print speed: about 220 mm/s (40 ppm)
Load during rubbing: 0.5 N/cm$^2$
Number of rubbing times: 5
Table 1 shows performance evaluation results of the Comparative Examples 1 to 3 and the first exemplary embodiment.

TABLE 1

Table 1 Performance evaluation results of the Comparative Examples 1 to 3 and the first exemplary embodiment

| Configuration | quick start performance | end temperature rise [condition 1] A4 width | end temperature rise [condition 2] B5 width | A5 width | A6 width |
|---|---|---|---|---|---|
| Comparative Example 1 | ○ | x | ○ | x | x |
| Comparative Example 2 | ○ | x | ○ | ○ | x |
| Comparative Example 3 | ○ | x | ○ | ○ | ○ |
| First Exemplary embodiment | ○ | ○ | ○ | ○ | ○ |

In the case of the configuration of the Comparative Example 1 having a width of 4.5 mm, while quick start performance is satisfactory, suppression effects of a non-sheet passing portion temperature rise during intermittent printing of the A4 size recording material and non-sheet passing portion temperature rises during continuous printing of the A5 and A6 size recording materials are small, and throughput-down control must be performed. In the case of the B5 size recording material, the temperature rise was lower than that of the A4 size recording material, and a non-sheet passing region was narrower than those of the A5 and A6 size recording materials. Thus, even when the heat transfer member was 4.5 mm, quick start performance and a non-sheet passing portion temperature rise were satisfied.

In the case of the configuration of the Comparative Example 2 having a width of 6.0 mm, while a heat capacity increases and a non-sheet passing portion temperature rise during continuous printing of the A5 recording material tends to be good, suppression effects of non-sheet passing portion temperature rises during intermittent printing of the A4 size recording material and during continuous printing of the A6 size recording material are not satisfied. Quick start performance in Comparative Example 2 was almost satisfied.

In the case of the configuration of the Comparative Example 3 having a width of 7.5 mm, a non-sheet passing portion temperature rise during intermittent printing of the A4 size recording material and a non-sheet passing portion temperature rise during continuous printing of the A6 size recording material of the smallest width both were problem-free levels. However, in the Comparative Example 3, since a heat capacity of the heat transfer member was large, quick start performance was degraded.

In the first exemplary embodiment, quick start performance and non-sheet passing portion temperature rises of the A4, A5, and A6 size recording materials were satisfied.

Figure 7:
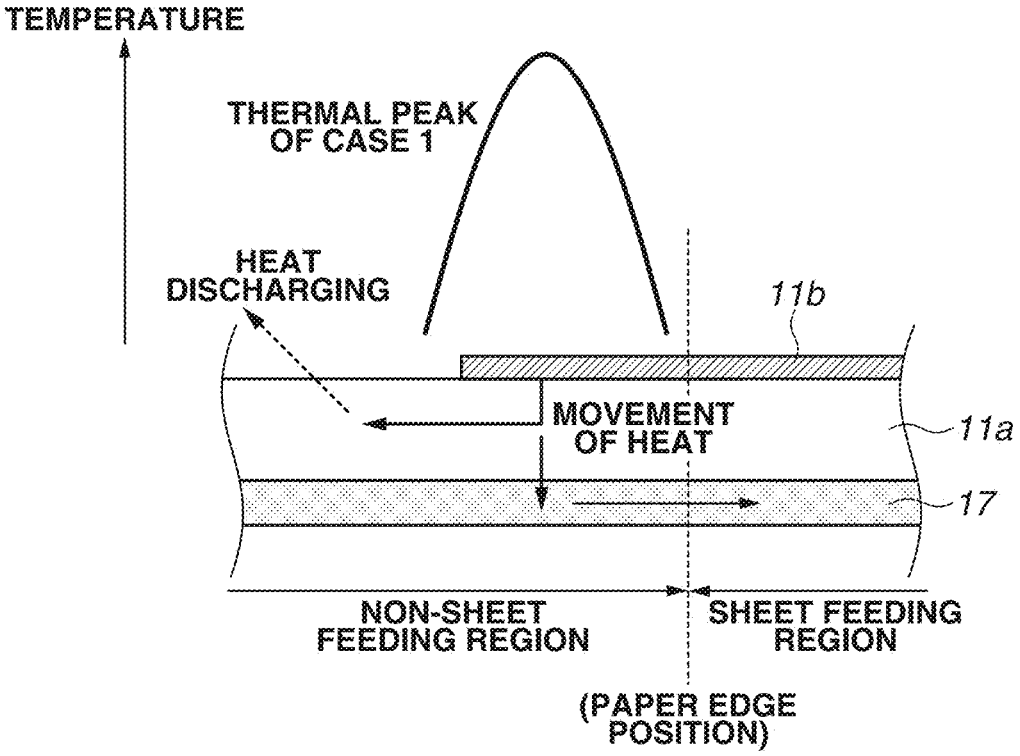
FIG. 7 is a diagram illustrating a thermal peak of a non-sheet passing region and a heat movement path in a case 1.

A thermal peak position due to a non-sheet passing portion temperature rise is a non-sheet passing region of 2 to 3 mm outside from a position of an end of a fed recording material in the width direction, and heat thereof moves in thickness, width, and longitudinal directions via the heat transfer member. However, thermal peaks due to non-sheet passing portion temperature rises are different in appearance between when a large recording material such as the A4 size recording material is subjected to intermittent printing (case 1) and small recording materials such as the B5 to A6 recording materials are subjected to continuous printing (case 2). FIG. 7 is a schematic diagram illustrating a thermal peak of the case 1. The thermal peak in the case 1 where a fixing temperature is high and a non-sheet passing region is narrow becomes easily steep. Generally, a length of a heat generation resistor is substantially equal to that of the maximum width paper. In the present exemplary embodiment, relative to a length 220 mm of the heat generation resistor, that of LTR that is the maximum width paper is about equal, i.e., 218 mm. Accordingly, when a recording material having a large width is subjected to printing, an immediate outside of a sheet-feeding region is a portion where no heat generation resistor is formed on the substrate. Thermal conductivity of alumina, which is a material of the substrate, is not so large compared with that of aluminum, which is a material of the heat transfer member. However, a discharging rate in air via the substrate, of heat of the non-sheet passing portion temperature rise in the case 1 is larger. Accordingly, in order to increase a suppression effect of the non-sheet passing portion temperature rise in the case 1, a heat capacity of the thermal peak position (position of 2 to 3 mm from the end of recording material in the width direction) is preferably increased. The portion 17*b* where the heat transfer member is extended is desirable for the purpose of suppressing the non-sheet passing portion temperature rise of the A4 size recording material.

Figure 8:
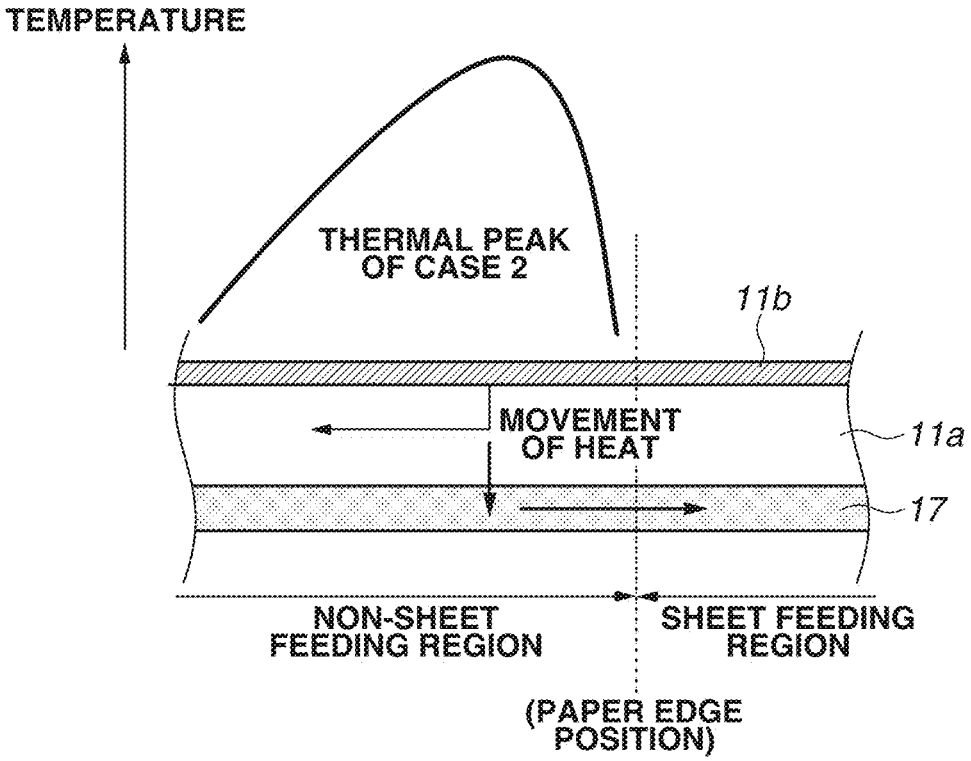
FIG. 8 is a diagram illustrating a thermal peak of a non-sheet passing region and a heat movement path in a case 2.

FIG. 8 is a schematic diagram illustrating a thermal peak of the case 2. A heat distribution in the case 2 where a fixing temperature is lower than that of the case 1 and a non-sheet passing region is wider is broad. A total amount of moving heat is proportional to a temperature gradient, and thus heat of a non-sheet passing portion moves particularly to a sheet feeding region. Accordingly, in order to increase a suppression effect of the non-sheet passing portion temperature rise in the case 2, a heat capacity of a portion of the sheet feeding region is advisably increased more than those of the thermal peak position and a heat peak position. However, when a portion of a large heat capacity of the heat transfer member is expanded to an image region, an adverse effect in image may occur. Thus, this portion is desirably limited outside the image region.

To sum up, in the case 2, it is preferred to increase the heat capacity of the thermal peak position (non-sheet passing region near end of standard-sized recording material) or the heat capacity outside the image region among the sheet-feeding regions in addition to the thermal peak position. Thus, the portion 17*c* where the heat transfer member has been expanded in the width direction is suitable for suppressing the non-sheet passing portion temperature rise of the A5 size recording material, and the portion 17*d* where the heat transfer member has been expanded in the width direction is suitable for suppressing the non-sheet passing portion temperature rise of the A6 size recording material.

As apparent from the foregoing, according to the present exemplary embodiment, suppression of the non-sheet passing portion temperature rise and quick start performance of the fixing apparatus can be simultaneously achieved.

In the present exemplary embodiment, the processable standard-sized recording materials are A4, B5, A5, and A6. However, similar effects can be acquired even in the case of other standard-sized recording materials. A heat capacity of only a non-sheet passing region near the end of a standard-sized recording material having the largest width except that of the largest width conveyable by the apparatus may be increased. The image forming apparatus according to the present exemplary embodiment can process sheets up to the LTR size recording material. However, effects similar to those of the present exemplary embodiment can be acquired even for standard-sized recording materials used in recording materials up to a sheet of an A3 size.

In the present exemplary embodiment, the configuration where the heater contacts the inner surface of the film is employed. However, a configuration where the heater contacts an outer surface of the film may be employed.

Figure 9A:
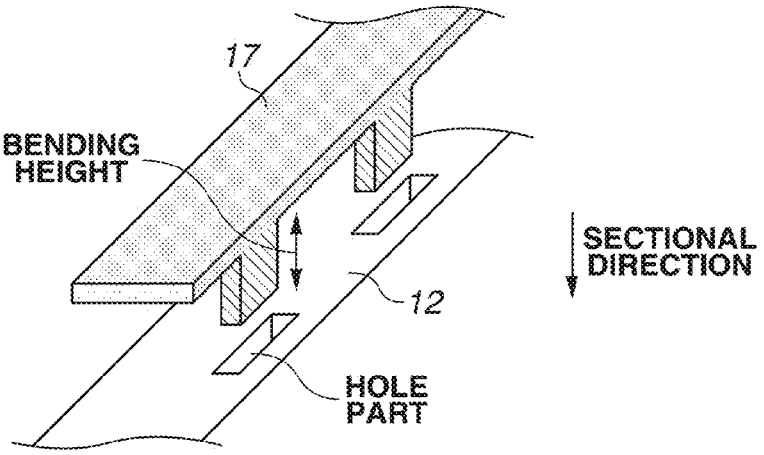
FIG. 9A is a perspective view illustrating a heat transfer member and a support member according to a second exemplary embodiment.

A second exemplary embodiment will be described. The second exemplary embodiment employs a configuration similar to that of the first exemplary embodiment except for the heat transfer member 17 and the support member 12. Description of common components will be omitted. Concerning the heat transfer member 17 according to the second exemplary embodiment, a technical idea, specifically, a heat capacity of a portion (first portion) corresponding to a region near an end of a recording material in a width direction among non-sheet passing regions relative to the standard-sized recording material is set larger than that of a portion (second portion) corresponding to a center of the standard-sized recording material in the width direction, is similar to that of the first exemplary embodiment. A difference of the second exemplary embodiment from the first exemplary embodiment is, as illustrated in FIG. 9A, that a portion projecting toward a side where the support member 12 is located is provided in the portion of the heat transfer member 17 corresponding to the region near the end of the recording material in the width direction among the non-sheet passing regions relative to the standard-sized recording material. FIG. 9A illustrates the configuration where the projecting portion is provided in the support member 12. In the present exemplary embodiment, a material of the projecting portion is similar to that of the heat transfer member 17. The projecting portion is inserted into the support member 12.

The projecting portion of the heat transfer member 17 functions as a portion for engaging the heat transfer member 17 in the support member 12, and the heat transfer member 17 is difficult to shift in a direction orthogonal to a conveying direction of the recording material or in the conveying direction of the recording material even when it receives a force from the film 13. As a result, shifting of a part of a large heat capacity where the projecting portion of the heat transfer member 17 is provided from a thermal peak position of a non-sheet passing portion is prevented, and a suppressing effect of a non-sheet passing portion temperature rise can be stably acquired.

Figure 9B:
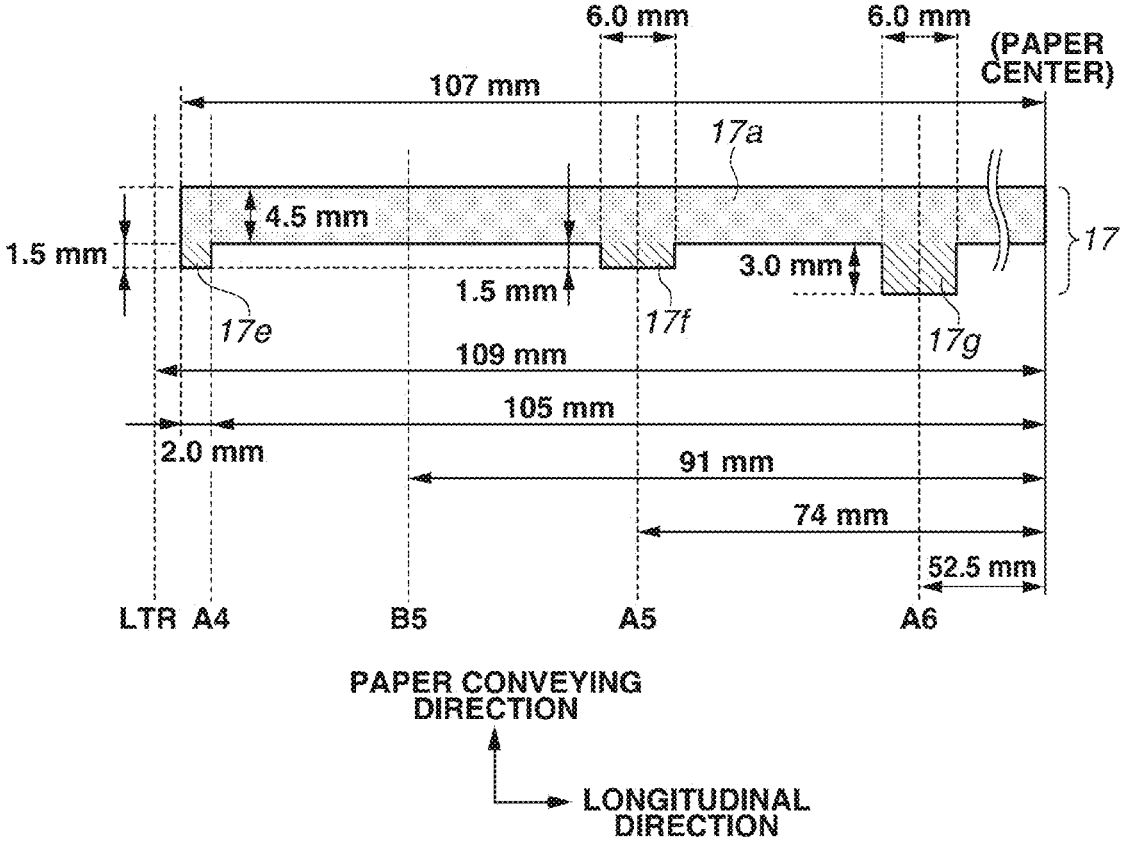
FIG. 9B is a diagram illustrating a shape (developed state) of the heat transfer member in a longitudinal direction according to the second exemplary embodiment.

FIG. 9B is a development view illustrating, for easier understanding of the heat transfer member 17, portions (17*e*, 17*f*, and 17*g*) projecting to the side where the support member 12 is located and developed to be parallel to a plane of the heat transfer member 17. The heat transfer member 17 is symmetrical left and right at a position corresponding to a recording material center (paper center), and thus FIG. 9B illustrates only a half.

The heat transfer member 17 according to the present exemplary embodiment is a plate having a length of 214 mm and a thickness of 0.3 mm. A width of a portion of the heat transfer member 17 corresponding to the center of the recording material is 4.5 mm. The projecting portions (17*e*, 17*f*, and 17*g*) are portions formed by bending an end of the heat transfer member 17 of the plate in a conveying direction of the recording material. The bent portion 17*e* is formed at a position of 105 to 107 mm from the recording material center, and a bending height (length from a surface of heat transfer member 17 that contacts support member 12 to bent portion tip) is 1.5 mm. The bent portion 17*f* is formed at a position of 69 to 77 mm from the recording material center, and a bending height is 1.5 mm. The bent portion 17*g* is formed at a position of 49.5 to 55.5 mm from the recording material center, and a bending height is 3.0 mm. The bent portion 17*e*, the bent portion 17*f*, and the bent portion 17*g*, respectively, are provided to be engaged in the support member 12 so as to stably acquire suppression effects of non-sheet passing portion temperature rises of an A4 size recording material, an A5 size recording material, and an A6 size recording material.

A configuration where a bent portion is provided in a heat transfer member as in the case of the second exemplary embodiment can contribute to miniaturization and cost reduction of an apparatus. While the film diameter must be set large in the configuration of the first exemplary embodiment where a part of the heat transfer member is expanded in the width direction, in the configuration of the second exemplary embodiment, there is no need to set any large film diameter since the bent portion can be absorbed by a thickness of the support member. While a thick plate is processed to be used in the configuration of the first exemplary embodiment where a thickness of a part of the heat transfer member is set large, only a thin plate needs to be bent in the configuration of the second exemplary embodiment.

Thus, according to the present exemplary embodiment, by providing the engaging portion in the portion of the heat transfer member corresponding to the region near the end of the recording material in the width direction among the non-sheet passing regions relative to the standard-sized recording material to partially increase the heat capacity, an effect of simultaneously achieving suppression of the non-sheet passing portion temperature rise and quick start performance of the fixing apparatus can be stably acquired.

A third exemplary embodiment will be described. Components of the third exemplary embodiment are similar to those of the first and second exemplary embodiments except for a heat transfer member, and thus only the heat transfer member will be described. The heat transfer member according to the third exemplary embodiment has a portion where a heat capacity is partially increased in one of two regions divided at a center of a recording material in a conveying direction. The core metal 21 of the pressure roller 20 includes shafts extending left and right from both end surfaces of a rubber layer. A length of the shaft is longer on a side where a driving member such as a gear is provided in the shaft than that on a side where no driving member is provided. Heat of the rubber layer is more easily released to the shaft to discharge on the longer side of the shaft than on the short side, and thus it is difficult to degrade a non-sheet passing portion.

In the heat transfer member according to the third exemplary embodiment, only in a region of a side where the short shaft of the shafts of both sides of the pressure roller is located, a heat capacity of a portion corresponding to a region near an end of a recording material in a width direction among non-sheet passing regions relative to a standard-sized recording material is set larger than that of a portion corresponding to a center of the standard-sized recording material. As a configuration where a heat capacity of a part of the heat transfer member is increased, a configuration where a width and a thickness of a part of the heat transfer member are increased and a bent portion is provided as in the case of the first and second exemplary embodiments can be employed.

As apparent from the foregoing, according to the present exemplary embodiment, since the heat capacity of the heat transfer member can be reduced more than that in the first and second exemplary embodiments, further FPOT shortening can be achieved while suppressing a non-sheet passing portion temperature rise.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-026096 filed Feb. 14, 2014, which is hereby incorporated by reference herein in its entirety.

What is claimed is:

1. A fixing apparatus for fixing an image on a recording material, comprising:

a cylindrical film;

a heater configured to heat the film, the heater contacting an inner surface of the film, the heater including a substrate and a heat generating resistor;

a heat transfer member configured to contact a surface of the heater opposite to a surface of the heater that contacts the inner surface of the film, the heat transfer member having a thermal conductivity higher than that of the substrate; and a support member configured to support the heater via the heat transfer member, wherein the image is fixed on the recording material by using heat of the film, wherein a heat capacity per unit length of a first portion of the heat transfer member that includes a region in which an end of a standard-sized recording material in a width direction of the standard-sized recording material passes is larger than that of a second portion of the heat transfer member which corresponds to a region in which a center of the standard-sized recording material in the width direction passes, wherein the first portion of the heat transfer member includes an engaging portion for engaging the heat transfer member with the support member, and wherein the heat transfer member is a plate, and the engaging portion is a bent portion formed by bending an end of the plate in a short direction of the plate.

2. The fixing apparatus according to claim 1, further comprising a roller configured to form a nip portion with the heater via the film, wherein the recording material is heated while being conveyed through the nip portion, and the image is fixed on the recording material.

3. The fixing apparatus according to claim 2, further comprising a roller configured to form a pressure portion with the heater via the film, wherein the roller includes a core metal and a rubber layer formed outside the core metal; and wherein a heat capacity of only the first portion included in, of two regions divided at a center of a heating region of the recording material in a longitudinal direction, the region of a side where a length of the core metal is short is larger than that of the second portion.

4. The fixing apparatus according to claim 1, wherein a width of the first portion of the plate is wider than that of the second portion of the plate.

5. The fixing apparatus according to claim 1, wherein in the longitudinal direction of the heater, a heat capacity per unit length of the first portion corresponding to a first standard-sized recording material is smaller than that of the first portion corresponding to a second standard-sized recording material narrower in width than the first standard-sized recording material.

6. The fixing apparatus according to claim 1, wherein the heat transfer member is a metal plate or a graphite sheet.

* * * * *